US007284308B2

(12) United States Patent
Akeda et al.

(10) Patent No.: US 7,284,308 B2
(45) Date of Patent: Oct. 23, 2007

(54) METHOD FOR MANUFACTURING A LEAF SPRING

(75) Inventors: Mamoru Akeda, Yokohama (JP); Junichi Yano, Yokohama (JP); Isamu Okuyama, Yokohama (JP); Akira Tange, Yokohama (JP)

(73) Assignee: NHK Spring Co., Ltd., Yokohama (JP)

( * ) Notice: Subject to any disclaimer, the term of this patent is extended or adjusted under 35 U.S.C. 154(b) by 521 days.

(21) Appl. No.: 10/499,015

(22) PCT Filed: Nov. 29, 2002

(86) PCT No.: PCT/JP02/12552

§ 371 (c)(1),
(2), (4) Date: Jul. 7, 2004

(87) PCT Pub. No.: WO03/055643

PCT Pub. Date: Jul. 10, 2003

(65) Prior Publication Data

US 2005/0028902 A1 Feb. 10, 2005

(30) Foreign Application Priority Data

Dec. 26, 2001 (JP) ..... 2001-395058

(51) Int. Cl.
*B23P 25/00* (2006.01)
*C21D 9/02* (2006.01)
*B60G 11/02* (2006.01)

(52) U.S. Cl. ..... 29/90.7; 29/446; 72/53; 148/580; 148/908; 267/229; 267/36.1; 267/40; 267/158

(58) Field of Classification Search ..... 29/90.7, 29/446; 72/53; 267/229, 36.1, 40, 158; 148/580, 908
See application file for complete search history.

(56) References Cited

U.S. PATENT DOCUMENTS

| | | | | |
|---|---|---|---|---|
| 959,801 | A | 5/1910 | Pendry | |
| 2,249,678 | A * | 7/1941 | Wallace | 72/53 |
| 2,252,823 | A * | 8/1941 | Wallace | 72/53 |
| 3,073,022 | A * | 1/1963 | Bush et al. | 72/53 |
| 3,094,768 | A | 6/1963 | Croft | |
| 3,238,072 | A * | 3/1966 | Greene et al. | 148/580 |
| 4,909,866 | A | 3/1990 | Abe et al. | |
| 5,225,008 | A | 7/1993 | Koyama et al. | |
| 6,544,360 | B1 * | 4/2003 | Tange et al. | 148/580 |

FOREIGN PATENT DOCUMENTS

| | | |
|---|---|---|
| JP | 05-148537 A | 6/1993 |
| JP | A 2000-345238 | 12/2000 |
| JP | A 2002-345238 | 11/2002 |
| WO | WO 00/75381 A1 * | 12/2000 |

* cited by examiner

*Primary Examiner*—Jermie E. Cozart
(74) *Attorney, Agent, or Firm*—Oliff & Berridge, PLC

(57) ABSTRACT

Leaf springs have improved durability in spite of using inexpensive spring steel such as SUP9 and SUP11 as materials. While a spring main body, made of the spring steel in which Brinell hardness is under 555 HBW and not less than 388 HBW (corresponding to a diameter of under 2.70 mm of hardness and not less than 3.10 mm of hardness on a Brinell ball mark), is maintained at 150 to 400° C., the load is applied in the direction in which the spring main body is to be used, and the first shotpeening is performed at the plane where the tensile stress acts.

4 Claims, 7 Drawing Sheets

METHOD FOR MANUFACTURING A LEAF SPRING

BACKGROUND OF THE INVENTION

1. Field of the Invention

The present invention relates to a leaf spring for a suspension in cars such as passenger cars, trucks, buses, and trains, and the like, and relates to a production process for the same, and particularly relates to technologies to maximally improve the durability thereof.

2. Description of the Related Art

Heretofore, a leaf spring for a car (hereinafter referred to simply as a "leaf spring") is produced, after forming a spring steel, by quenching, tempering, and performing a shotpeening at ordinary temperatures. The shotpeening in this case is a process in which shot made from steel are impacted at high speed on a surface, in which tensile stress occurs when the leaf spring is mounted in a car, thereby generating compressive residual stress in the surface portion and improving durability.

In recent years, a stress-peening in which shotpeening at ordinary temperatures is performed to impart stress to the spring steel is also known, as proposed in U.S. Pat. No. 959,801 and Japanese Patent Application, First Publication, No. 148537/93. In such stress-peening, a large residual compressive stress can be obtained compared to that in conventional shotpeening.

Spring steels for leaf springs, SUP6 (silicon manganese steel), SUP9 or SUP9A (manganese chrome steel) and SUP11A (manganese chromium boron steel) have been popular, and Brinell hardness thereof after heat treatment of hardening and tempering is 388 to 461 HBW (corresponding to a diameter of 2.85 to 3.10 mm on a Brinell ball mark). In recent years, research on the use of SUP10 (chromium vanadium steel) of which the Brinell hardness is 444 to 495 HBW (corresponding to a diameter of 2.75 to 2.90 mm on a Brinell ball mark). According to this steel type, since the hardness is high and the grain can be fine, the durability can be further improved, although the residual compressive stress is approximately equal to that in the case in which the stress-peening is performed.

FIG. 8 is an S-N diagram showing results of an endurance test using a leaf spring (1) which is the steel type of SUP9 or SUP9A, SUP11A and in which the shotpeening at ordinary temperature is performed after the heat treatment, a leaf spring (2) which is of the same steel type as the leaf spring (1), in which stress-peening at ordinary-temperature is performed after the heat treatment, and a leaf spring (3) which is of the steel type of SUP10 in which stress-peening is performed after the heat treatment. It should be noted that in this endurance test, the stress (mean stress) of 686 MPa was set in the leaf spring, and a stress amplitude was given to the stress. As shown in FIG. 8, the endurance frequencies were shown to be (1)<(2)<(3). Residual compressive stresses in the leaf springs (2) and (3) were 80 kgf/mm$^2$.

Thus, in the case of performing the stress-peening by using SUP10, the durability is greatly improved. However, there is a disadvantage in that the material cost for SUP10 is high since it is more expensive than SUP6 and SUP9.

SUMMARY OF THE INVENTION

Objects of the present invention are to provide a leaf spring having durability equal to SUP10 performed by a stress-peening even if inexpensive materials such as SUP9 and SUP11 are used, and a process for producing the same.

The process for producing a leaf spring of the present invention is characterized in that while a spring main body, made of the spring steel in which Brinell hardness is under 555 HBW and not less than 388 HBW (corresponding to a diameter of less than 2.70 mm at a hardness of over 3.10 mm of hardness on a Brinell ball mark), is held at 150 to 400° C., the load in the direction equal that in the condition of use is imparted to the spring main body, and the first shotpeening is performed in the plane where the tensile stress acts.

Hereinafter, the reasons for the above-mentioned numerical value limitations are explained with the action of the present invention. The shotpeening in the present invention may also be called a warm stress-peening in the following descriptions.

Spring Steel Hardness: 388 to 555 HBW

FIG. 1 shows an S-N diagram of the endurance frequency concerning the leaf spring, made of the spring steel in which the hardness after quenching and tempering is variously set, in which warm stress-peening was performed.

This warm stress-peening was performed by holding at 250 to 300° C., while a stress of 1400 MPa was applied in the plane in which the tensile stress of the leaf spring acts.

This endurance test was conduced under the conditions of a mean stress of 686 MPa and at a stress amplitude of 720 MPa.

As shown in FIG. 1, in the case in which the hardness of the spring steel is a hardness corresponding to a diameter of under 2.70 mm over 3.10 mm on a Brinell ball mark (HBD), an endurance frequency of 100000 times can be ensured. However, in the case in which the value of the hardness deviates from the range, the endurance frequency becomes less than 100000 times.

HBD is shown as the diameter of dents produced at the time of pressing a cemented carbide sphere in which the diameter is 10 mm to the sample surface at the 3000 kgf of load. This is the reason the hardness of the spring steel is over 2.70 mm in HBD, the notch sensitivity rose to increase variability of the durability, and thereby decreased the average endurance frequency. Also, in the case in which the material is hard, a problem occurs in that the hardness of the shot of the stress-peening is lower than that of the material. This means that the processing by the shot becomes difficult, and the forming of a compressive residual stress layer which is the most effective in the fatigue strength improvement becomes insufficient, and it is also connected with an essential problem in that the fatigue strength is not improved.

In addition, low temperature creep characteristics (setting resistance) is reduced in the case of under 3.1 mm in HBD, and thereby, the endurance frequency is also lowered. FIG. 2 shows a diagram of a result of measuring residual shear strains in the case in which warm stress-peening was performed on the spring body made of the spring steel in which the hardness after quenching and tempering is variously set, and next the stress of 100 MPa is applied to the spring body for 72 hours, and finally the stress was removed. As shown in FIG. 2, in the case in which the hardness of the spring steel is under 3.10 mm in HBD, the residual shear strain rapidly increases, and thereby the setting resistance is lowered.

Warm Stress-Peening Temperature: 150 to 400° C.

FIG. 3 shows a diagram of the relationship between depth from the material surface and size of the residual compressive stress, concerning the leaf springs made of various steel types, in which the maintenance temperature after quenching and tempering was variously set and in which stress-peening was performed. As shown in FIG. 3, in the case of performing the warm stress-peening at 150° C., in spite of using the typical spring steel such as SUP9, the compressive residual stress is larger and the depth thereof is deeper than those in the case of performing the stress-peening for SUP10 at ordinary temperatures. In addition, in the case of performing the warm stress-peening at 400° C., the compressive residual stress is rapidly increased, and the depth thereof is also drastically deepened. In contrast, in the case of performing the stress-peening for typical materials at ordinary temperatures, the residual compressive stress is lower than that in the case of performing the stress-peening for SUP10 at ordinary temperatures, and in the case of performing the shotpeening for typical materials at ordinary temperatures, the residual compressive stress is further lowered. Therefore, it is apparent that the increase of the endurance frequency can be carried out, even if the material is inexpensive, by performing the stress-peening under conditions of maintaining the material at 150 to 400° C.

When the maintenance temperature in the stress-peening exceeded 400° C., a machining ratio by the stress-peening is large, and thereby the surface roughness was increased, and as a result, the notch sensitivity was increased to lower the endurance frequency. Furthermore, when the maintenance temperature in the stress-peening exceeded 400° C., a remarkable release of the residual compressive stress also became a cause of lowered durability. It is desirable that the maintenance temperature in the shotpeening be 150 to 350° C., and preferable that it be 250 to 325° C.

DESCRIPTION OF THE PREFERRED EXAMPLES

Hereinafter, an embodiment of the present invention will be described.

It is desirable that 1200 to 190 MPa of the tensile stress be given on the surface by the load applied to spring main body so as to perform the warm stress-peening in the present invention more effectively. According to research by the inventors, when the value of the tensile stress is under 1200 MPa, the residual compressive stress becomes inadequate. When the value of the tensile stress is over 1900 MPa, especially in the case when the steel type is SUP11A, breakage in the hole formed in the stress-peening at the center of the leaf spring may occur.

Furthermore, it is suitable that the second shotpeening be performed at the plane where the tensile stress acts, after the first shotpeening, using shot having an average particle size which is less than the average particle size of the shot used in the first shotpeening, and by imparting the load in a direction which is same as the direction in use to the spring main body. Thereby, it is possible to impart a plastic deformation of most of the surface portion of the spring main body by using shot of small diameter, and the durability is further improved by raising the compressive residual stress of the part. More specifically, it is preferable that the average particle size of the shot used in the first shotpeening be 0.8 to 1.2 mm, and that the average particle size of the shot used in the second shotpeenings be 0.2 to 0.6 mm.

According to the production technique of the leaf spring as the above, even if the leaf spring is made of inexpensive materials such as SUP9, durability which is not less than that in the case of performing the stress-peening on SUP10 can be obtained. Therefore, an object of the present invention is to provide a leaf spring produced by the production technique like the above, in which the residual compressive stress is distributed within the range at a depth of 0.4 to 0.6 mm from the surface in the plane where the tensile stress acts, and in which the maximum value of the residual compressive stress is 800 to 1800 N/mm$^2$.

Suitable spring steels to be used for this invention are SUP9 and SUP11, etc., and are preferably steels having compositions shown in the following Table 1.

TABLE 1

| | C | Si | Mn | P | S | Cr | B | Fe |
|---|---|---|---|---|---|---|---|---|
| SUP9 | 0.56 ~0.6 | 0.15 ~0.35 | 0.8 ~1.00 | not more than 0.03 | not more than 0.03 | 0.8 ~1.00 | — | residue |
| SUP11 | 0.56 ~0.64 | 0.15 ~0.35 | 0.8 ~1.00 | not more than 0.03 | not more than 0.03 | 0.8 ~1.00 | 0.0005 ~0.005 | residue |

Figure 1:
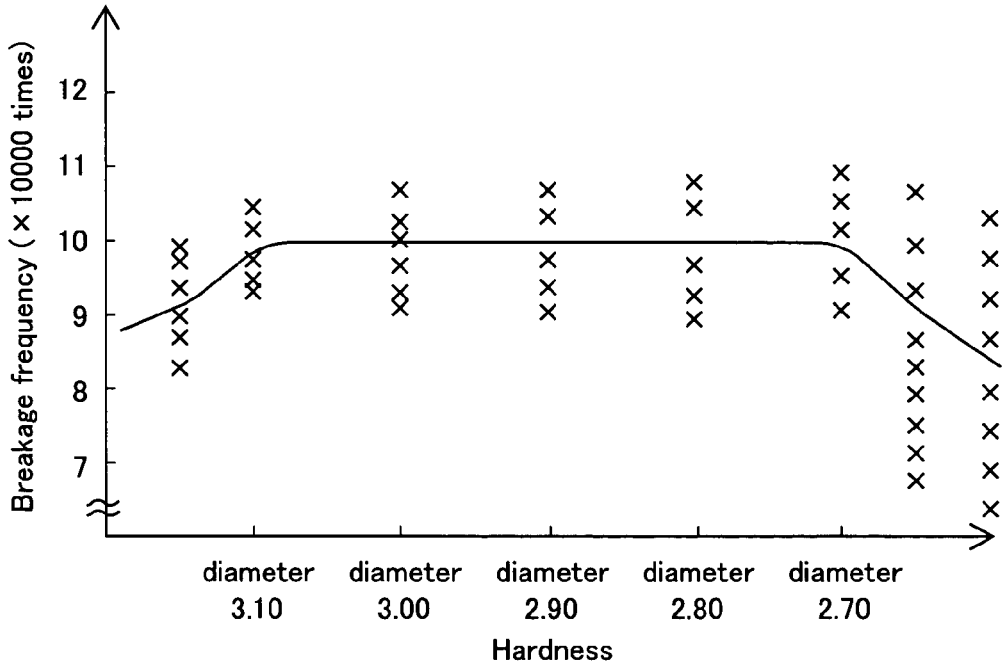
FIG. 1 is a graph showing the relationship between hardness and breakage frequency for explaining the action of the present invention.
Figure 2:
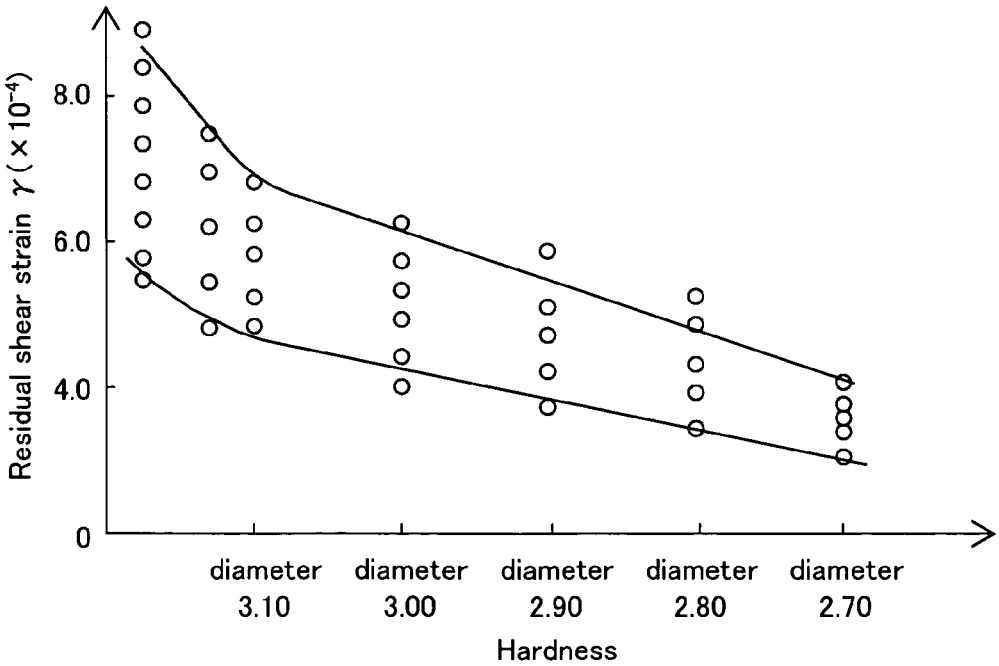
FIG. 2 is a graph showing the relationship between hardness and residual shear strain for explaining the action of the present invention.
Figure 3:
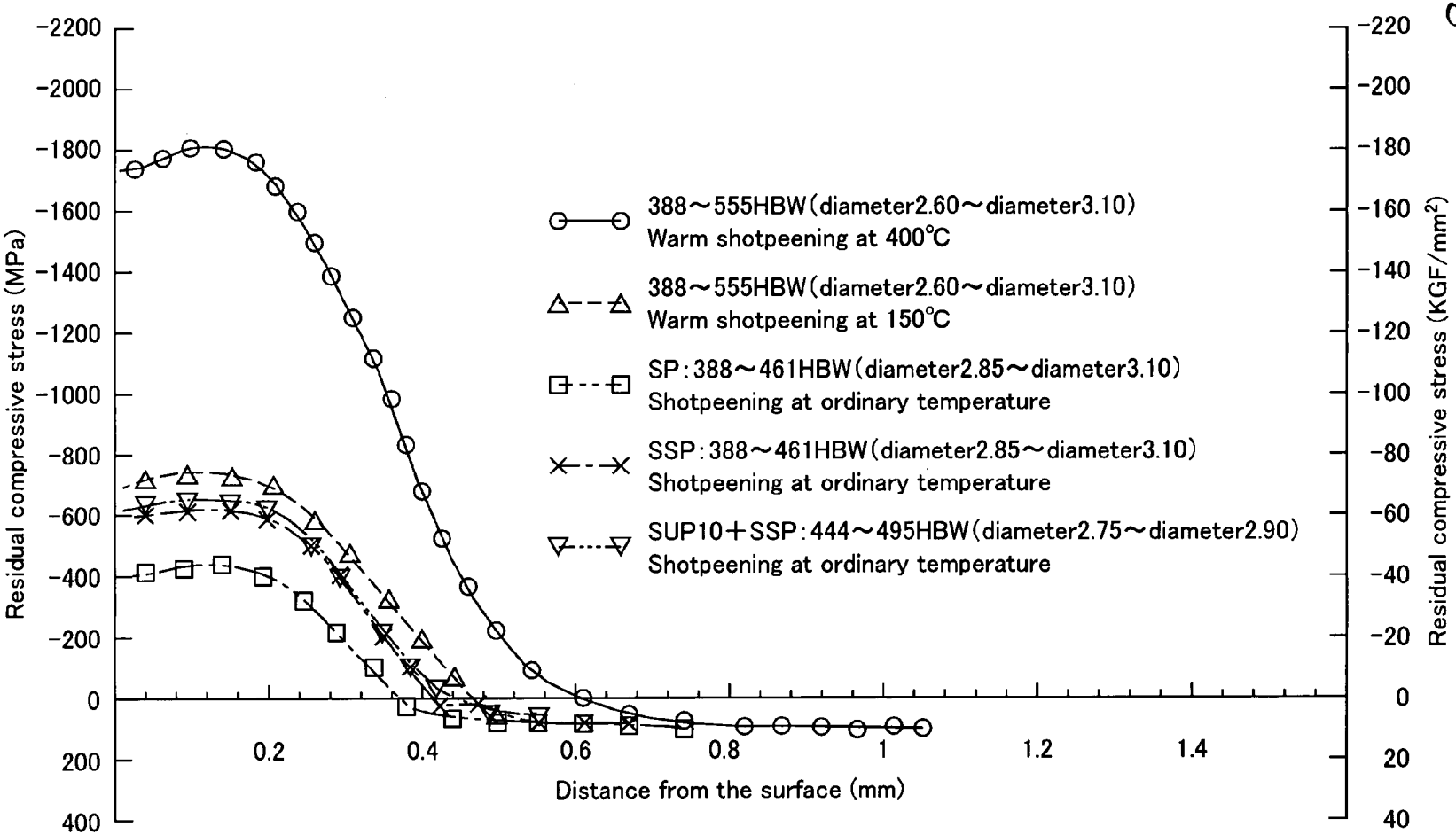
FIG. 3 is a graph showing the relationship between distance from the surface and residual compressive stress for explaining the action of the present invention.
Figure 4A:
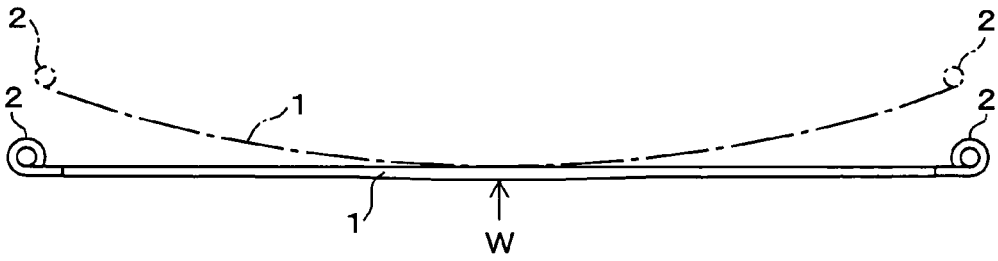
FIG. 4A is a side view of a leaf spring in an embodiment of the present invention.
Figure 4B:
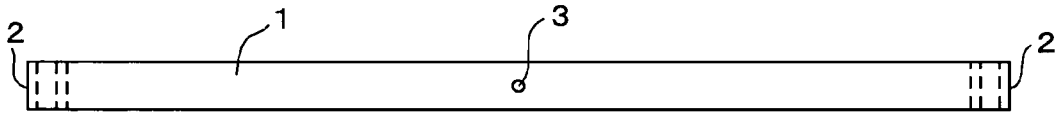
FIG. 4B is a bottom view of the same.

FIG. 4 is a diagram showing a leaf spring in an embodiment of the present invention. This leaf spring is provided with attaching portions 2 which are formed by winding both end portions of spring main body 1 from a central portion to both sides of which the thickness gradually decreases. Furthermore, in the central portion of spring main body 1, a hole 3 is formed in which a part such as a bracket is fixed. This leaf spring is formed in a bent shape as shown by a dashed line in the Figure, and in the use condition, the load shown by W in the Figure is imparted in the direction of the arrow.

Figure 5:
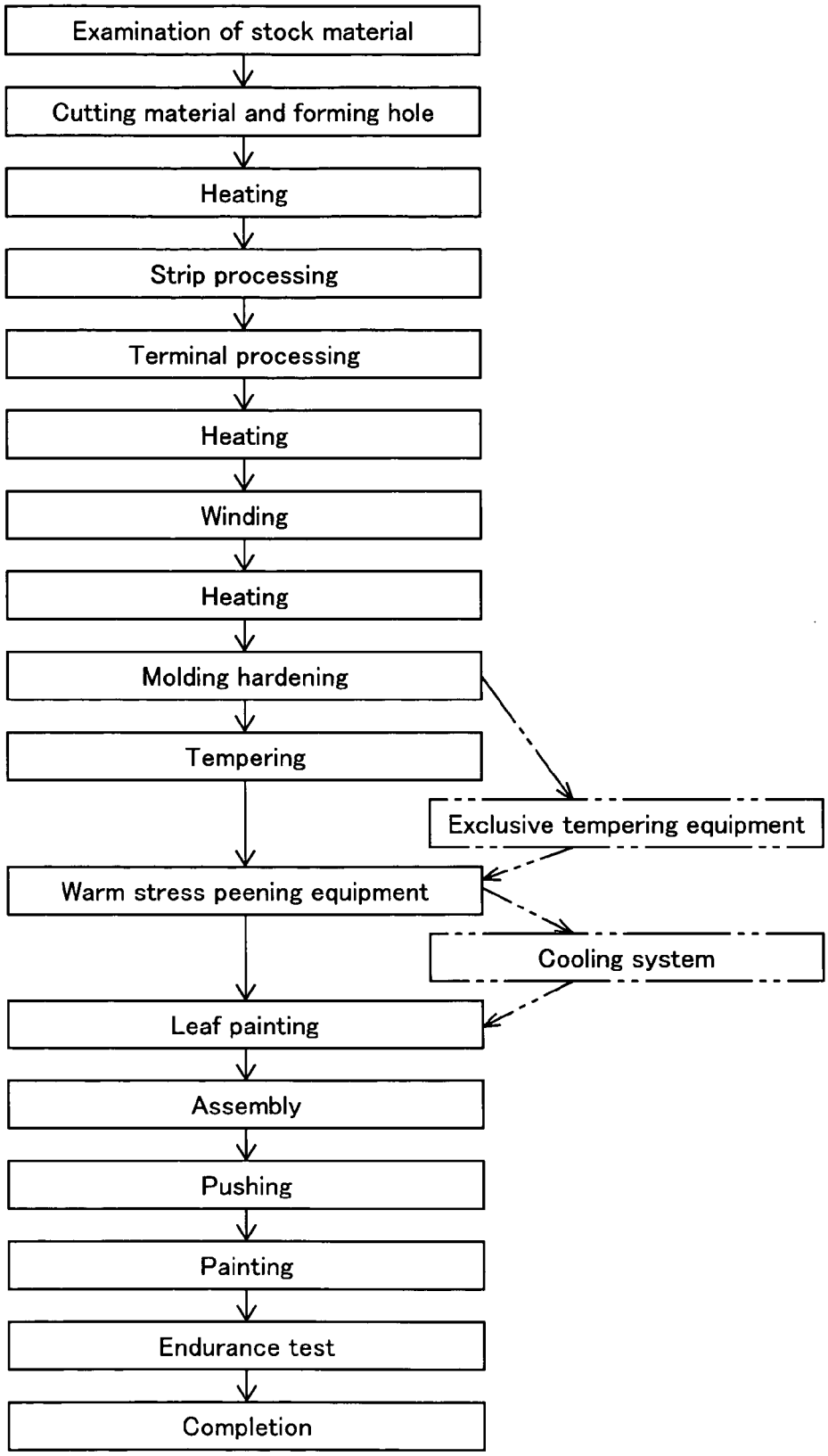
FIG. 5 is a diagram showing a manufacturing process of the leaf spring in an embodiment of the present invention.

FIG. 5 is a flowchart showing a process for producing the above-mentioned leaf spring. First of all, stock material was examined, the material was cut into plates of fixed dimensions, and each plate was provided with hole 3 in the center by machining. Next, strip processing was performed so that both end portions gradually formed a thin wall by heating the plate. Next, the parts, which will be wound, in both end portions of the plate, are machined in order that the width of the parts gradually decrease, and by winding both end portions after the heating, attaching portions 2 are formed. Semiprocessed goods of leaf springs formed in this way are formed in bent shapes after the heating, and are hardened by placing into a hardening tank. Afterwards, the semiprocessed goods were tempered, stress-peening was performed on the goods in a warm stress-peening equipment held in a temperature region of 150 to 400° C. At this time, the load in the direction of the arrow shown in FIG. 4 was added to semiprocessed goods by an adequate jig and shot is impinged on the semiprocessed goods from a direction of the opposite side of the arrow.

Next, semiprocessed goods after natural cooling were painted, and a bracket, etc., was assembled from the semiprocessed goods, and semiprocessed goods of plural pieces are combined in proportion to the specifications. Afterwards, the pushing, in which a load which exceeds the limit of elasticity in the load direction during use was added and was performed for the assembly body of the leaf spring, and this assembly body became a finished product of the leaf spring by being subjected to painting and inspection.

Although a warm stress-peening equipment which was held at a warm temperature was used in the above manufacturing process, an ordinary temperature stress-peening equipment can also be used. That is to say, as shown by a two-dot chain line of FIG. 5, it is also possible for an exclusive tempering equipment to be set at the right over of the ordinary temperature stress-peening equipment, and the semiprocessed goods which left the tempering equipment is held in the ordinary temperature stress-peening equipment before the goods are cooled, and thereby the stress-peening is performed. Alternatively, it is also possible for the semiprocessed goods which were left in the warm or ordinary temperature stress-peening equipment to be cooled in a cooling system in order to shorten the manufacturing time.

EXAMPLES

Practical Example 1

Figure 6:
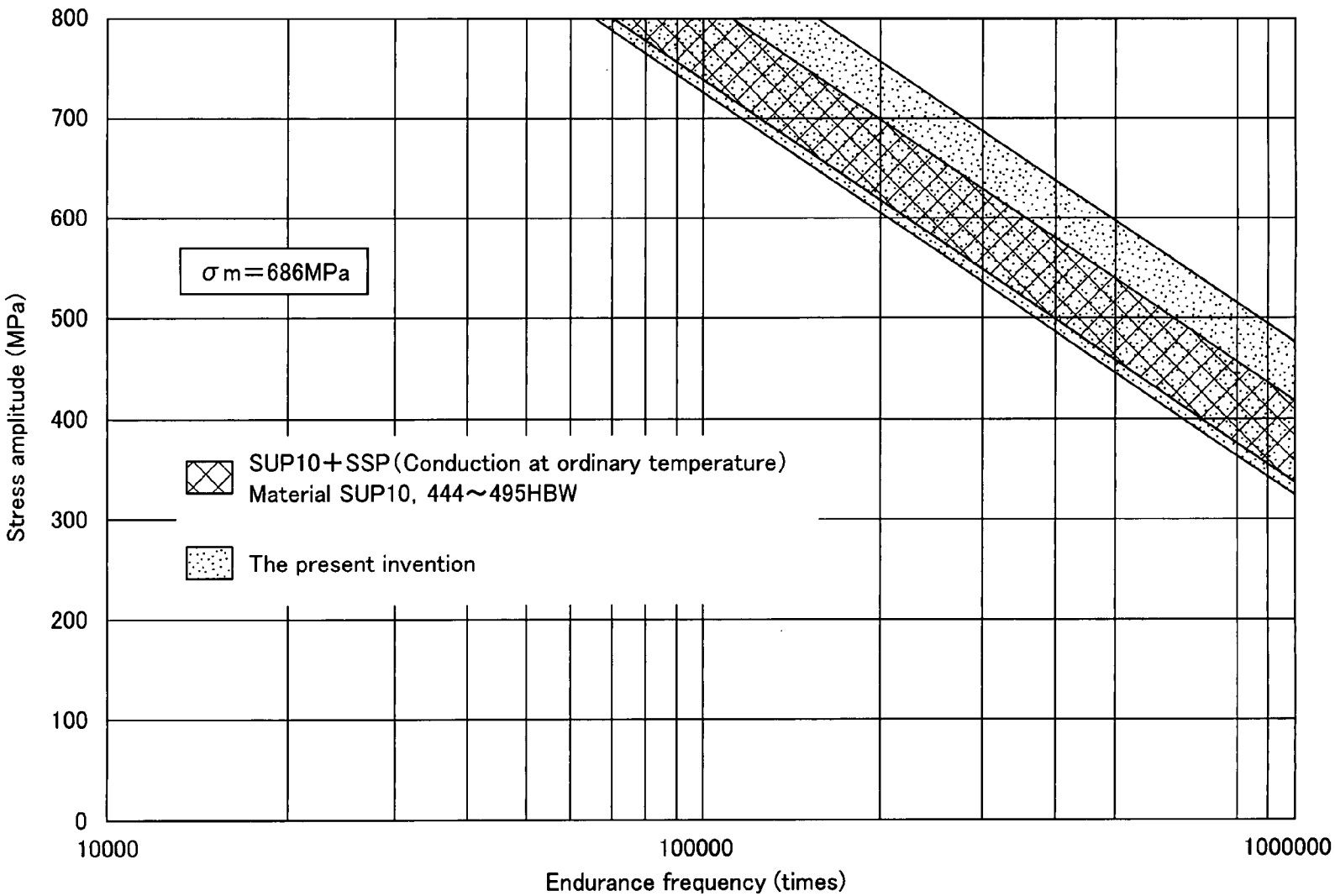
FIG. 6 is an S-N diagram in the practical example of the present invention.

Next, this invention is explained in further detail by showing concrete manufacturing examples. A plate made of SUP9 was formed in the shape as shown in FIG. 4, and the warm stress-peening was performed after hardening and tempering. The warm stress-peening was performed by retaining at 250 to 300° C., while applying a stress of 1400 MPa at the plane where the tensile stress of the leaf spring acts. Next, an endurance test, in which the mean stress of 686 MPa was set and a stress amplitude was variously set, was carried out. Furthermore, for comparison, a plate made of SUP10 was formed in the shape as shown in FIG. 4, and the stress-peening was performed while applying a stress of 1400 MPa after hardening and tempering. For this leaf spring, the endurance test was carried out under conditions the same as the above. The results are given in FIG. 6. As shown in FIG. 6, the leaf spring which was subjected to the warm stress-peening, of the present invention, had an endurance frequency which was not less than that in the case of performing the stress-peening for SUP10.

Practical Example 2

The leaf springs as shown in FIG. 4 were produced by using various spring steels. At that time, shotpeening at ordinary temperature (SP), stress-peening at ordinary temperature (SSP), or warm stress-peening (WSSP) was performed on the leaf springs. In this case, shotpeening at ordinary temperature (SP) and stress-peening at ordinary temperature (SSP) were performed by applying stress of 900 MPa, and warm stress-peening (WSSP) was performed by holding at 250 to 300° C. while applying stress of 1400 MPa.

Figure 7:
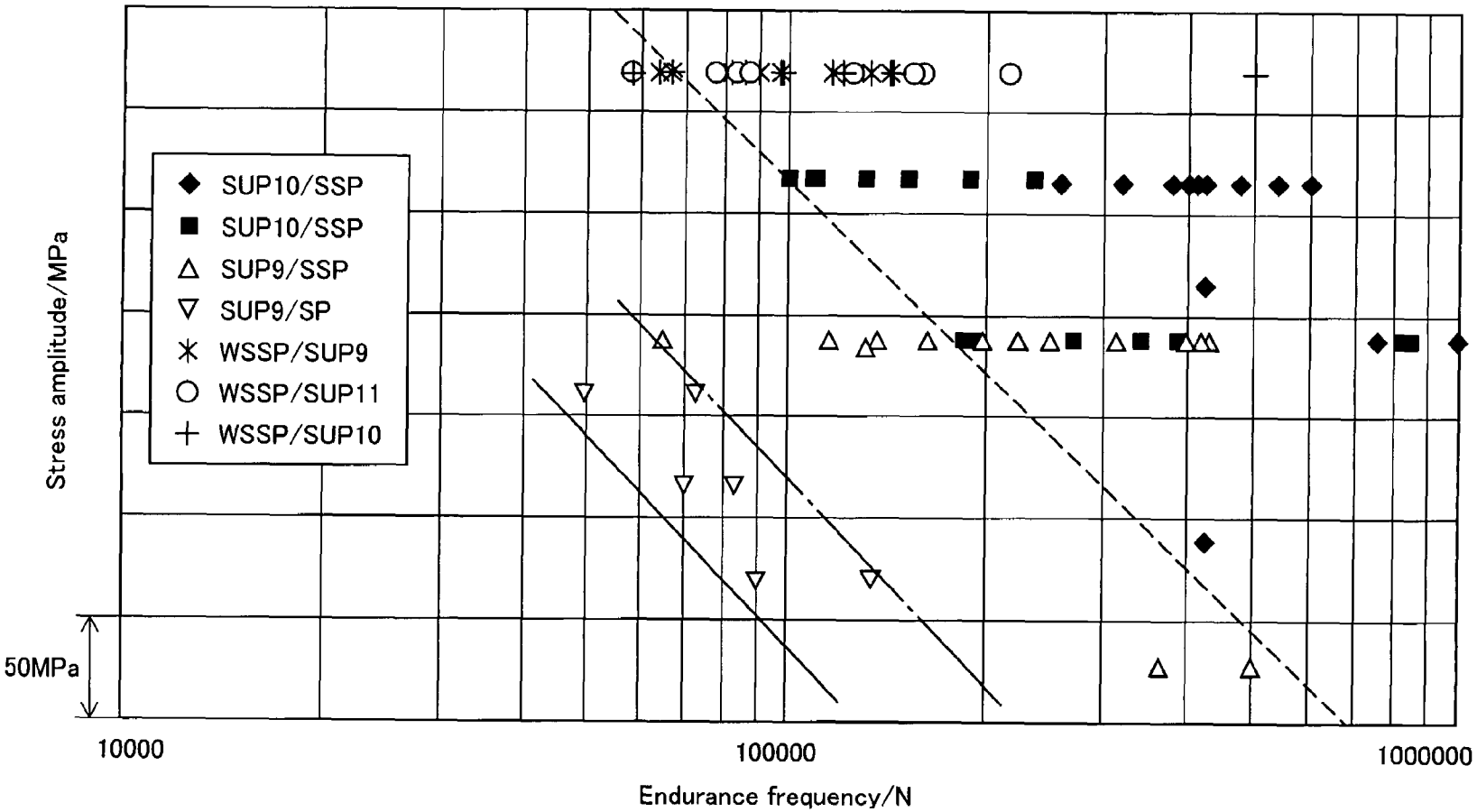
FIG. 7 is other S-N diagram in the practical example of the present invention.
Figure 8:
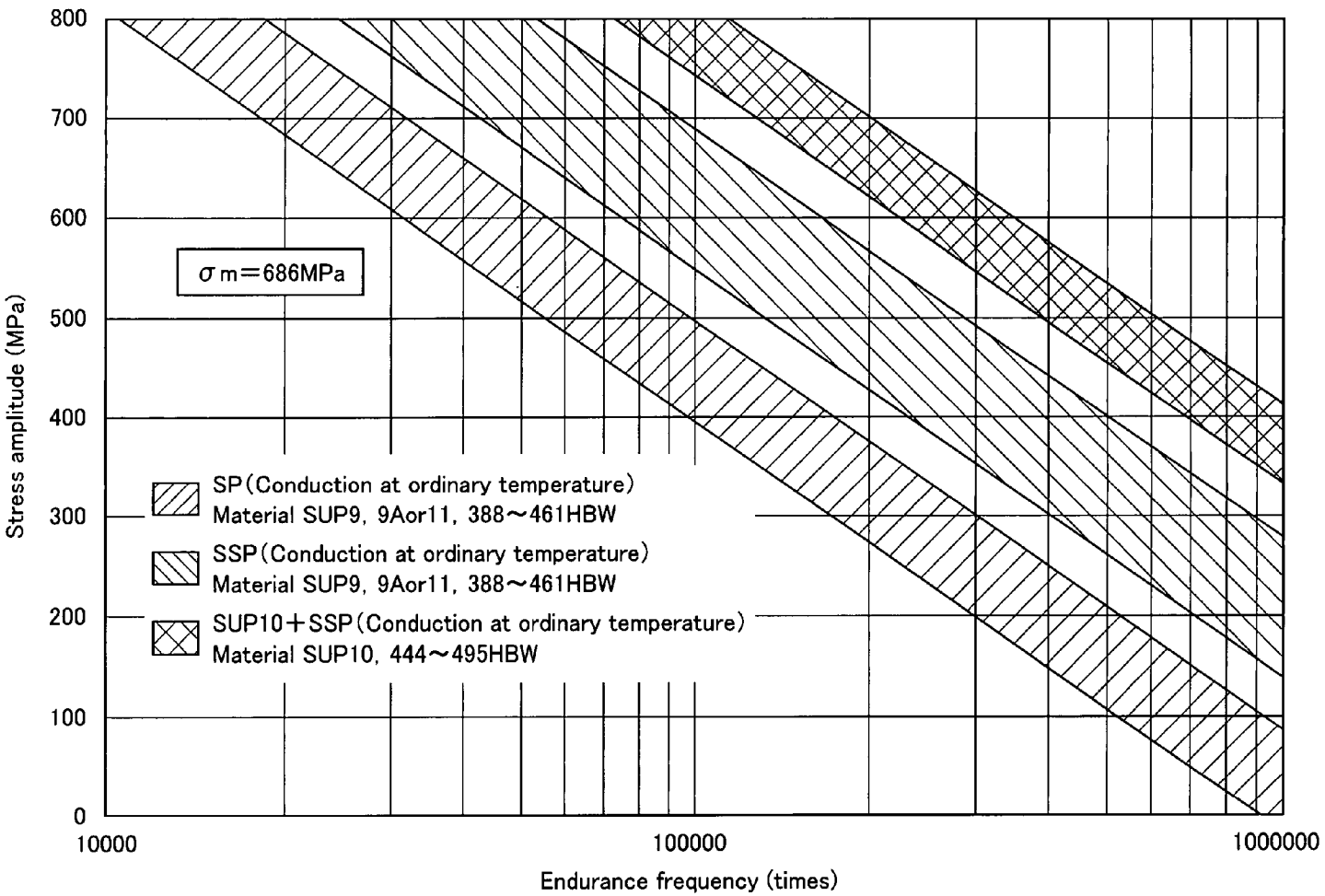
FIG. 8 is an S-N diagram in the conventional leaf spring.

For the above leaf spring, endurance tests were carried out by setting a mean stress of 686 MPa and various stress amplitudes. The results are given in FIG. 7. In FIG. 7, minimum values of plots, in the case in which the stress-peening at ordinary temperature was performed for SUP10, are connected. In the case in which the warm stress-peening was performed for SUP9 and SUP11, plots exist at the top or right side of the broken line; therefore, the endurance frequency which is not less than that in the case of performing the stress-peening at ordinary temperature for SUP10 is clearly shown.

What is claimed is:

1. A production process for a leaf spring for a car, the process comprising:

holding a spring main body made from a spring steel in which a Brinell hardness is under 555 HBW and not less than 388 HBW, the hardness of the spring steel corresponding to a diameter of under 2.70 mm of hardness and not less than 3.10 mm of hardness on a Brinell ball mark, at 150° to 400° C.;

applying a load to the spring main body in a direction that is the same direction of a load to be applied in actual use; and performing a first shotpeening at a plane of the spring main body where a tensile stress is applied to the spring body, wherein the tensile stress of 1200 to 1900 MPa is applied by the load.

2. The production process for the leaf spring for the car, according to claim 1, wherein a second shotpeening is performed at the plane where the tensile stress acts, after the first shotpeening, using a shot having an average particle size which is less than an average particle size of a shot used in the first shotpeening.

3. The production process for the leaf spring for the car, according to claim 2, wherein the average particle size of the shot used in the first shotpeening is 0.8 to 1.2 mm, and the average particle size of the shot used in the second shotpeening is 0.2 to 0.6 mm.

4. A production process for a leaf spring for a car, the process comprising:

holding a spring main body made from a spring steel in which a Brinell hardness is under 555 HBW and not less than 388 HBW, the hardness of the spring steel corresponding to a diameter of under 2.70 mm of hardness and not less than 3.10 mm of hardness on a Brinell ball mark, at 150 to 400° C.;

applying a load to the spring main body in a direction that is the same direction of a load to be applied in actual use; and performing a first shotpeening at a plane of the spring main body where a tensile stress is applied to the spring main body, wherein a residual compressive stress is distributed within a range in depth of 0.4 to 0.6 mm from a surface in the plane where the tensile stress acts, and a maximum value of the residual compressive stress is 800 to 1800 $N/mm^2$.

* * * * *